US005129231A

United States Patent [19]

Becker et al.

[11] Patent Number: 5,129,231

[45] Date of Patent: Jul. 14, 1992

[54] COOLED COMBUSTOR DOME HEATSHIELD

[75] Inventors: James T. Becker, Jupiter, Fla.; Thomas A. Auxier, Palm Beach Gardens, both of Fla.

[73] Assignee: United Technologies Corporation, Hartford, Conn.

[21] Appl. No.: 492,188

[22] Filed: Mar. 12, 1990

[51] Int. Cl.[5] ..... F02C 3/02

[52] U.S. Cl. ..... 60/754; 60/756

[58] Field of Search ..... 60/752, 756, 754, 755, 60/748

[56] References Cited

U.S. PATENT DOCUMENTS 3,447,317 6/1969 Dakin ..... 60/756
4,380,905 4/1983 Smart et al. ..... 60/756
4,422,300 12/1983 Dierberger et al. ..... 60/754
4,695,247 9/1987 Enzaki et al. ..... 60/755
4,914,918 4/1990 Sullivan ..... 60/756

FOREIGN PATENT DOCUMENTS 268524 5/1950 Switzerland ..... 60/756
351800 3/1961 Switzerland ..... 60/756

*Primary Examiner*—Richard A. Bertsch
*Assistant Examiner*—Timothy S. Thorpe
*Attorney, Agent, or Firm*—Norman Friedland

[57] ABSTRACT

The heatshield for the fuel nozzles mounted at the dome of an annular combustor for a gas turbine engine is cooled by discretely locating cool air film cooling holes in the heatshield oriented to inject the cooling air with the recirculation zone to be compatible with the direction of the swirling air in the recirculated zone.

4 Claims, 2 Drawing Sheets

COOLED COMBUSTOR DOME HEATSHIELD

DESCRIPTION

1. Technical Field

This invention relates to gas turbine engines and more particularly to the cooling of the combustor dome heatshield.

2. Background Art

Historically, heatshields, which are basically a plate made from specialized heat resistant material, are disposed between the part being protected and the flame, and were and are still utilized to protect the structure of the combustor from the heat generated in the process of combustion within the combustor of a gas turbine engine. To this end these heatshields, particularly of the type that protect the domes, are cooled by impingement techniques directed to the cold side of the heatshield. Hence, cool air obtainable from the compressor is routed through impingement cooling holes to impinge on the forward side of the heatshield. With reference to the sides of the heatshield, it is to be understood that the forward side is the side that does not face the fire in the combustor (cool side) and the aft side is the side that faces the fire (hot side). In a typical installation, the heatshield surrounds the fuel injector and is slightly spaced from and supported to the dome. Compressor air is the source of cooling air diverted from the engine's flow path to impinge on the forward side of the heatshield.

The spent cooling air or partially spent cooling air is then directed through gaps around the heatshield into the burner. This air may also provide some film cooling of other combustor components. Because of the constraints on the availability of the cooling air and the environment to which the heatshield is subjected, the heatshield is a critical part and it is abundantly important that the proper pressure level of the cooling air is obtained to assure that proper cooling will be sustained. Hence, great care and concern is given to the sizing of the heatshield and its relationship to the other associated component parts particularly with the gaps through which cooling air flows. The heretofore known heatshields described above, gave adequate protection but given the high heat loadings associated with aggressive, shorter length burners, these conventional techniques are no longer sufficient to afford the necessary protection that is either needed or desired. At best, conventional cooling has made cooling of the heatshield very difficult, if not impossible.

We have found that we can obtain satisfactory cooling of the heatshield. One of the more difficult problems that needed to be overcome and, which this invention addresses, is to provide a film cooling of the hot side in spite of an environment where there is a strong influence of swirling air occasioned by the forces generated in the recirculation zone in the combustor. The strong recirculation tends to draw the film of cooling air off the dome at an exceedingly high rate. Hence it is abundantly important that the film be continuously rejuvenated.

We have found that we can obviate the problems noted above by the judicious selection of film cooling holes discreetly located in the heatshield and which are uniquely angled relative to the direction of the helical flow field of the recirculation zone. Not only does this invention provide the necessary replenishment function alluded to above, the inclusion of holes in the heatshield provides additional cooling by the process of connection in the heatshield. Analytical studies have indicated that the average heatshield temperature is reduced approximately 200 degrees F. without providing any additional cooling air. Obviously, it is contemplated that the life of the heatshield will be substantially extended and a reduction in the required amount of cooling air potentially can be significantly reduced, which enhances the engine's overall performance.

DISCLOSURE OF THE INVENTION

An object of this invention is to provide an improved cooled heatshield for a gas turbine engine.

A further object of this invention is to provide a heatshield for the dome of a combustor of a gas turbine engine that incorporates film cooling of the hot side.

A further object of this invention is to provide an improved heatshield that orients the film cooling holes in the direction of the swirl of the recirculation zone that is characterized as being capable of extending the life of the heatshield and potentially saving on the amount of cooling air required to maintain the structural integrity.

The foregoing and other features and advantages of the present invention will become more apparent from the following description and accompanying drawing.

BEST MODE FOR CARRYING OUT THE INVENTION

Figure 1:
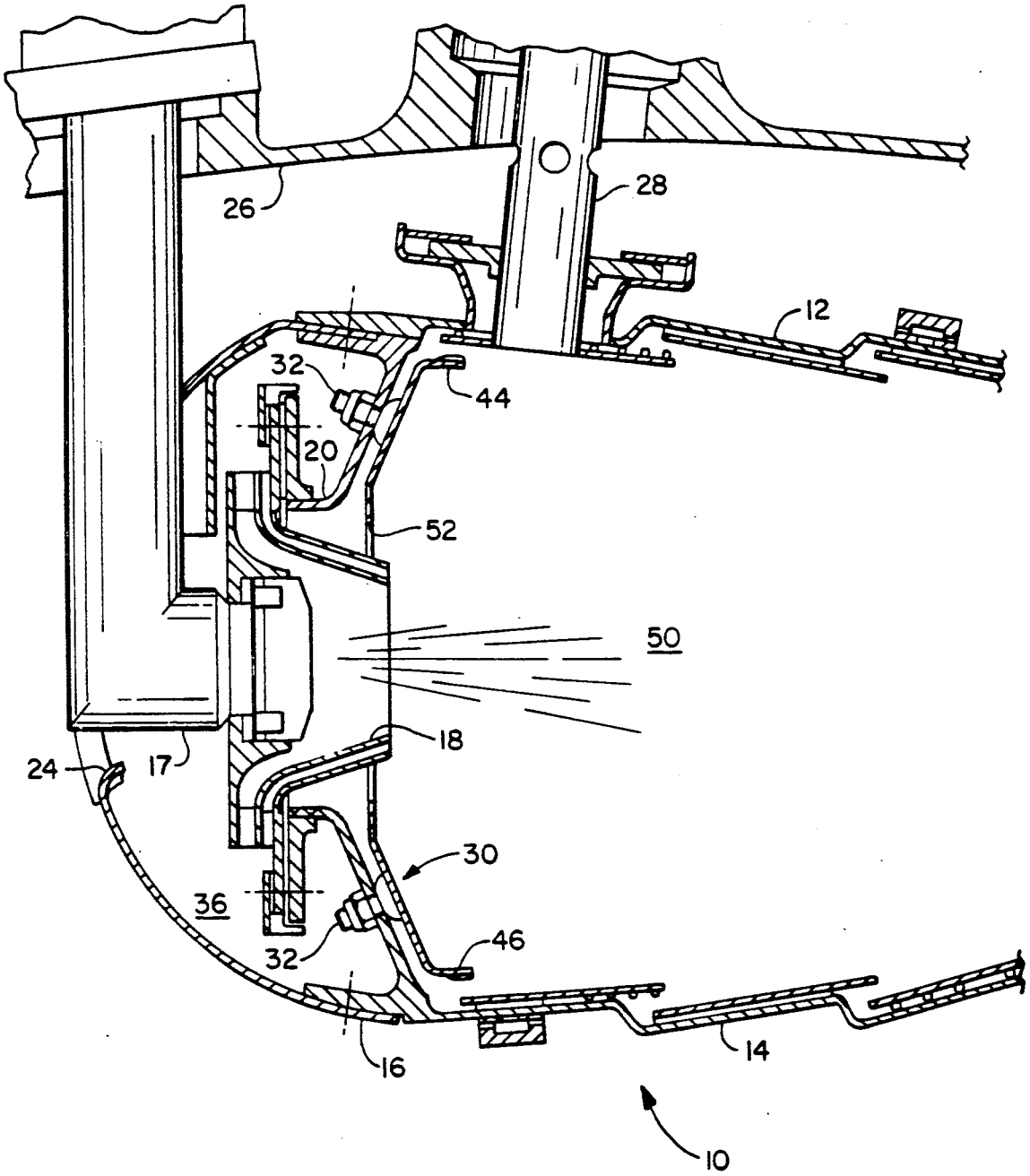
FIG. 1 is a partial view partly in cross section and partly in elevation of an annular combustor for a gas turbine engine employing this invention.
Figure 3:
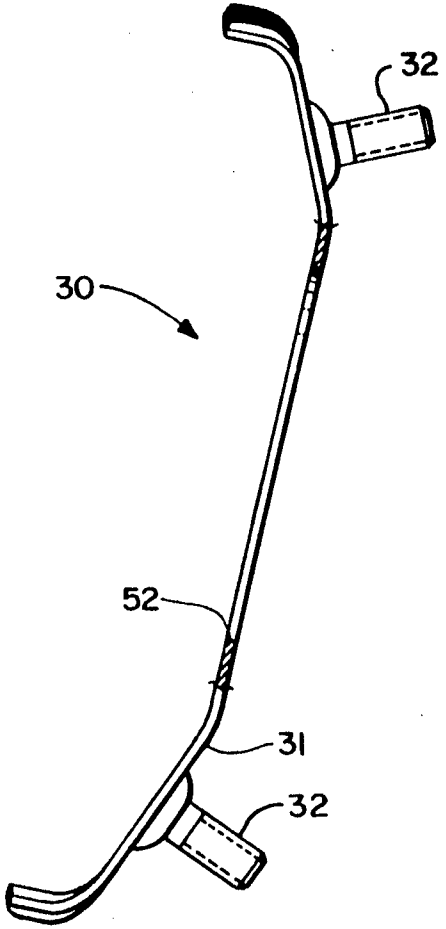
FIG. 3 is an end view taken along lines 3—3 of FIG. 2.
Figure 4:
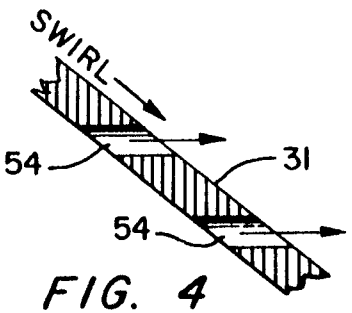
FIG. 4 is a partial sectional view taken along lines 4—4 of FIG. 2.

While this invention has utility wherever the environment subjects the heatshield to a field of swirling fluid flow as is the case of the front end of a combustor of a gas turbine engine, in the preferred embodiment this invention is particularly efficacious for use in engines such as the F100 manufactured by Pratt & Whitney, a division of United Technologies Corporation, the assignee of this patent application. As was mentioned herein above the heatshield as best shown in FIGS. 1 to 4 serves to protect the structure of the combustor from the intensity of the heat in the combustor. The annular combustor generally illustrated by reference numeral 10 comprises an outer annular wall 12 and an inner annular wall 14 fabricated from Floatwall liner for defining a combustion zone. Floatwall liner is described in U.S. Pat. No. 190 4,302,941 granted to T. L. DuBell on Dec. 1. 1981 and assigned to United Technologies Corporation. Dome 16 is supported to the inner annular wall 14 and outer annular wall 12 for enclosing off the forward end of the combustor. As is typical in these configurations, a plurality of fuel nozzles 17 and air swirl vanes 18 are adapted to fit into a plurality of apertures 20 circumferentially spaced in dome 16. An annular cowling 22 may be employed to form an aerodynamic cover for the front end of the combustor and likewise includes an aperture 24 by accommodating the fuel nozzle which is supported to the engine casing 26. A suitable igniter 28 also supported to engine casing 26 is typically employed shown and like the portion of the combustor just described is conventional in these types of combustors.

The heatshield generally illustrates by reference numeral 30 consist of a generally flat plate member 31 mounted to the dome 20 at the front end of the combustor by a plurality of lugs 32 that extend rearwardly from member 31 through openings in the dome and is secured by the nut and washer assembly 34. Air from the compressor (not shown) flows through aperture 24 into the cavity 36 and eventually flows through impingement holes 38 to impinqe on the cold side of member 31 of heatshield 30. The juttinq member 42 and the row of projections 42 that are formed at the slightly bent edges 44 and 46 of member 31 serve to assure that the gap between the heatshield and dome does not close due to distortions so as to maintain a continual flow of cooling air.

Figure 2:
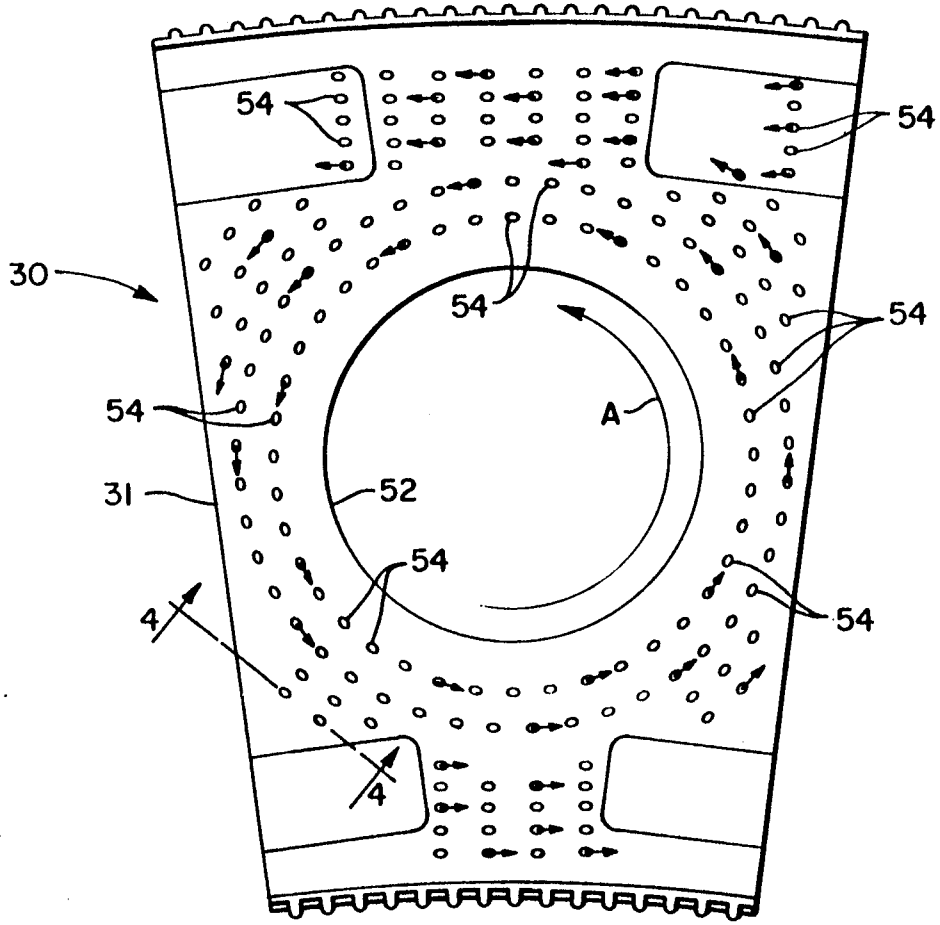
FIG. 2 is a front view of the heatshield employing this invention and showing the flow relationship of the fuel/air injector and cooling flow.

As noted in FIGS. 1 and 2, the fuel nozzle 17 is surrounded by the air swirlers 18 and communicate with the combustion zone 50 through the aperture 52 formed in the dome 20. The air swirlers 18 are designed to impart a swirl component to the air before egressing into the combustion zone as in say the direction indicated by Arrow A.

In accordance with this invention, a plurality of holes 54 are angularly formed in member 31 of heatshield 30 so as to lay a film of cooling air adjacent the heatshield surface of member 31. These holes may be drilled by mechanical electron, chemical means, etc. As is apparent from the foregoing, air passing through drilled holes 54 not only serve to lay a film of cool air on the hot side surface, the air also serves to convectively cool member 31. The number of film cooling holes and the spacings thereof is predicated on the heat load and the particular application. It being understood that the orientation of the holes is critical and is selected so that the film is continuously rejuvenated notwithstanding the affect of the recirculation zone in the combustor.

Although this invention has been shown and described with respect to detailed embodiments thereof, it will be understood by those skilled in the art that various changes in form and detail thereof may be made without departing from the spirit and scope of the claimed invention.

We claim:

1. A heatshield for a fuel nozzle/air swirler feeding fuel and air to the combustion zone of an annular combustor of a gas turbine engine, the air being injected by said air swirler in a given direction, said annular combustor having annular wall means defining said combustion zone, said heatshield comprising a plate-like member disposed between the fuel nozzle/air swirler and the flame in the annular combustor, means for cooling said plate-like member including a plurality of holes in said plate-like member angularly disposed relative to the planar surfaces of said plate-like member being oriented in such a direction to impart a swirl to cooling air flowing through said plate-like member into said combustion zone in the same direction as said given direction of the air injected by said air swirler to continuously rejuvenate the film of cooling air, said angularly disposed holes having a predetermined angle so as to lay a film of cooling air adjacent the face of said plate-like member facing the combustion zone, and said plate-like member extending radially toward said annular wall means and defining therewith a gap for continuously providing cooling air.

2. A heatshield as claimed in claim 1 including threaded parts extending from a surface of said plate-like members for supporting said plate-like member to said annular combustor.

3. A heatshield as claimed in claim 2 wherein said annular combustor includes a dome disposed on the forward end of said annular combustor relative to the flow of combustion gases for enclosing the forward end of said annular combustor, said threaded post extending through openings in said dome for accommodating fastening means to secure said plate-like member to said dome.

4. A heatshield as claimed in claim 3 wherein said fuel nozzle/air swirlers project through a central aperture in said plate-like member.

* * * * *

UNITED STATES PATENT AND TRADEMARK OFFICE

CERTIFICATE OF CORRECTION

PATENT NO. : 5,129,231

DATED : July 14, 1992

INVENTOR(S) : James T. Becker, et al

It is certified that error appears in the above-identified patent and that said Letters Patent is hereby corrected as shown below:

Col. 2, line 58, "Pat. No. 190 4,302,941" should read --Pat. No. 4,302,941--.

Signed and Sealed this

Thirty-first Day of August, 1993

Bruce Lehman

*Attest:*

BRUCE LEHMAN

*Attesting Officer*

*Commissioner of Patents and Trademarks*